US005787642A

United States Patent [19]

Coyle et al.

[11] Patent Number: 5,787,642

[45] Date of Patent: Aug. 4, 1998

[54] STORM SHUTTERS WITH LIGHT TRANSMITTANCE

[75] Inventors: Paul E. Coyle, 7441 NW. 12th St., Plantation, Fla. 33313; Joseph J. Barrett, 1-5 Willow Way, Reading, Pa. 19606; Wayne V. Lemanski, Pembroke Pines, Fla.; John Foley, 9081 SW. 55th Ct., Cooper City, Fla. 33328

[73] Assignees: Paul E. Coyle; Joseph J. Barrett; John Foley, all of Broward County, Fla.

[21] Appl. No.: 635,452

[22] Filed: Apr. 10, 1996

Related U.S. Application Data

[63] Continuation of Ser. No. 79,632, Jun. 18, 1993, abandoned.

[51] Int. Cl.[6] ..... E05B 65/04

[52] U.S. Cl. ..... 49/61; 49/50; 52/202

[58] Field of Search ..... 49/50, 57, 61, 49/62, 68, 463; 160/104, 383; 52/202, 208, 204.61, 204.71, 204.72, 203, 507, 653.1, 475.1, 476, 477, 656.2, 656.5, 656.6, 656.7, 656.8, 796.1, 797.1

[56] References Cited

U.S. PATENT DOCUMENTS

| | | | |
|---|---|---|---|
| 1,933,691 | 11/1933 | Young | 52/813 X |
| 2,382,566 | 8/1945 | Heckman | 52/473 |
| 2,611,936 | 9/1952 | Wheeler | 49/67 |
| 3,077,643 | 2/1963 | Horner | 52/473 |
| 3,160,927 | 12/1964 | Busillo | 49/57 |
| 3,374,597 | 3/1968 | Whitener | 52/656.7 X |
| 3,583,100 | 6/1971 | Catalano | 49/50 |
| 4,027,443 | 6/1977 | Briggs | 52/202 |
| 4,121,379 | 10/1978 | Everson | 49/61 |
| 4,198,796 | 4/1980 | Foster | 52/203 |
| 4,562,666 | 1/1986 | Young, III | 49/62 |
| 4,637,444 | 1/1987 | Tanner | 49/61 X |
| 4,876,828 | 10/1989 | Brill | 52/23 |

FOREIGN PATENT DOCUMENTS

| | | | |
|---|---|---|---|
| 1035847 | 4/1953 | France | 52/813 |
| 561513 | 5/1944 | United Kingdom | 52/813 |
| 1502329 | 7/1975 | United Kingdom | 52/813 |

*Primary Examiner*—Jerry Redman

*Attorney, Agent, or Firm*—Malin, Haley, DiMaggio & Crosby, PA

[57] ABSTRACT

A storm shutter for use in high wind severe storms, such as hurricanes and cyclones, that will protect windows, doors, and sliding glass doors on the outside of a building, which can be permanently or temporarily mounted, and which allow for protection in extremely high winds while permitting the transmission of light into the building, while allowing occupants in the building to look out through the storm shutters at all times. The storm shutters can also provide protection from intruders and ultraviolet rays from the sun when in place. Each shutter includes a rigid peripheral frame with a U-shaped channel, a polycarbonate transparent sheet, and an expanded aluminum element mounted snugly in the peripheral frame.

4 Claims, 2 Drawing Sheets

STORM SHUTTERS WITH LIGHT TRANSMITTANCE

This application is a continuation of application Ser. No. 08/079,632, filed Jun. 18, 1993, abandoned.

BACKGROUND OF THE INVENTION

1. Field of the Invention

This invention relates to storm shutters for temporarily or permanently covering exterior windows and doors to prevent damage from high winds, rains, and severe storms such as hurricanes and typhoons, and in particular, to an improved, highly durable storm shutter for windows or doors that can withstand great wind forces, while at the same time allow for the transmission of light through the storm shutters so that an occupant can see outdoors from within when the storm shutter is in place.

2. Description of the Prior Art

Storm shutters have become an essential component of a residential home or commercial building in certain areas of the United States due to the occurrence regularly of tropical and severe storms that generate extremely high winds and heavy rains. Such areas as South Florida and the Gulf of Mexico are prone to hurricanes, which can generate winds up to 200 mph. Stringent building codes in some of these areas have given rise to a variety of storm shutters that can be either permanently installed or removably moved from the window or door area through the use of manual or electrical devices so that during periods when there is no storm, the shutters can be moved out and away from the window area. Typically, these storm shutters are made of very rigid material, such as extruded aluminum, and are hinged together for movable storage in a rolled up form. Other types of storm shutters include extruded aluminum sheets that are pinned or screwed in place, or hinged, louvered shutters that can be moved up and back to allow some light in. Typical of most of these shutters, except for perhaps louvered shutters, is that once in place, they do not allow the transmission of light into the building. Therefore, during a severe storm, the occupants of the building are literally without an outside view and without light to see out to experience what is happening during the storm, or to even have light in the building because often, electric power fails and the building is without electricity and elementary lighting. Storm shutters have also become important for security reasons to prevent unauthorized access into residential and commercial buildings. However, again, with the storm shutter in place to provide maximum security, the occupant of the building is again without light to see out and cannot conveniently or practically keep the shutters in place at all times while occupying the building.

U.S. Pat. No. 5,099,904, issued to Susnar Mar. 31, 1992 for a "FOLDING SHUTTER PROVIDING SECURITY" shows the use of elongated, transparent, unprotected panels that slide in tracks and are folded. U.S. Pat. No. 5,155,936, issued to Johnson Oct. 20, 1992 shows a "SLIDING PANEL SHUTTER ASSEMBLY" that includes a transparent panel surrounded by a plurality of wooden rails. U.S. Pat. No. 5,097,883, issued to Robinson et al. Mar. 24, 1992 for a "FOLDING SHUTTER SYSTEM" shows the use of a small vent panel having a transparent shield. None of these devices show the use of complete storm shutters that provide strength and rigidity for high velocity winds at low cost, while allowing for light transmission.

The purpose of the present invention is to overcome the problems shown in the prior art by providing an extremely rigid storm shutter that is economical to install and will allow for wind protection over 200 mph, while at the same time allowing the occupant to have light transmission sufficient for providing light into the building while the shutters are in place, while at the same time allowing the occupants to look outward from the building.

SUMMARY OF THE INVENTION

This invention relates to an improved exterior storm shutter for use in protecting windows, sliding glass doors, and doors from severe wind and rain damage or flying object damage during storms such as hurricanes, that also allows for the transmission of light through the storm shutter to allow the inhabitants to view outward from the building. The storm shutters can be manufactured at reasonable cost, making them cost effective.

The storm shutter for a particular window, door, or sliding glass door is comprised of a rectangular, aluminum extruded channel frame, each of the frame members on each side being U-shaped in cross section, and having a predetermined dimension, such as one-half inch between the U-shaped channel members, a transparent, polycarbonate sheet, sized in thickness to receive each of the U-shaped frame members around its outside edge, and an expanded aluminum element that includes a plurality of openings typically in an assorted design, the expanded aluminum being of a predetermined thickness and being mounted flush against the polycarbonate sheet on one side, with an exterior perimeter shape and size as the polycarbonate sheet so that the exterior frame members receive both the peripheral edges of the polycarbonate sheet and the expanded aluminum element, fitting snugly in each U-shaped channel along each side. The four frame members with U-shaped channels, forming the exterior frame, may be riveted or bolted together by threaded fasteners to form a rigid shutter, having a sturdy aluminum frame, a one-quarter inch polycarbonate sheet, and a one-quarter inch aluminum member, which fit snugly within the one-half inch inside U-shaped frame channel dimension.

This basic storm shutter unit can be mounted over a window, door, or sliding glass door, in a multitude of different ways. Each storm shutter may be mounted in two U-shaped tracks, firmly attached to the building exterior at the window top and bottom, including stopping means at each end of the tracks so that the windows can be permanently mounted in place or can be removed by sliding them along and outside the frame members horizontally.

In a second embodiment, each storm shutter can be constructed of a corrugated, transparent polycarbonate sheet that has a predetermined thickness and substantially trapezoidally-shaped, cross sectional portions, which have flat, parallel sections spaced three-quarters of an inch apart or more for larger applications, that is used in conjunction with the expanded aluminum element to fit snugly within an extruded aluminum frame that is rigidly attached around the periphery of the polycarbonate corrugated sheet and the expanded aluminum element, firmly holding them in place. The various sizes in lengths and widths and thicknesses may be altered, depending on the size of the windows. The shutter may include two sections with an H-shaped center frame member to provide a storm shutter that includes two polycarbonate sheets of predetermined, substantially rectangular or square sizes, and two expanded aluminum elements mounted in a large, rectangular aluminum frame that is U-shaped, the frame including a center, rigid member that is H-shaped to receive both polycarbonate sheets on each side and both edges of the expanded aluminum. This could be used for large window mountings if necessary.

One advantage of the invention, and the primary advantage, is that there is sufficient spacing and openings between the expanded aluminum structural members that provide more than 50% lighting through the shutter when the shutter is mounted in place over a window or sliding glass door. This allows an occupant inside the building, when the storm shutters are installed, to easily peer outward, while at the same time allowing light into the building during daylight.

The second advantage is that the expanded aluminum pattern can be greatly varied for aesthetic purposes, providing round or diamond or square-type patterns across each of the openings. Each shutter also provides for ultraviolet ray protection of sunlight coming into the building because of the nature of the polycarbonate sheet, which in one example would be manufactured under the trademark Lexan, a registered trademark of the General Electric Company. These transparent Lexan polycarbonate sheets come in tinted or clear sheets, each of which has ultraviolet protection. Thus, if the storm shutter is permanently mounted over a window that receives intense sunlight, draperies or other objects inside the building can be likewise protected from ultraviolet rays.

If the improved shutters are installed, they can also reduce air conditioning bills by cutting down ultraviolet rays and providing additional insulation over windows and sliding glass door areas.

It is an object of this invention to provide an improved storm shutter for use in protecting residential and commercial buildings, and in particular, windows, doors, and sliding glass doors from destructive effects resulting from hurricanes or other severe windstorms, while allowing the transmission of light into the building when the shutters are in place.

It is another object of this invention to provide an improved storm shutter that allows the occupant to see out of a building through a window or sliding glass door when the storm shutter is in place, while at the same time protecting the building from unauthorized entrance for increased security.

It is another object of this invention to provide an improved storm shutter that allows for light transmission, while at the same time, protecting against extremely high winds and allowing for various decorative embellishments of the improved shutter for aesthetic purposes for use with residential and commercial buildings.

And yet still another object of this invention is to provide an improved storm shutter that allows for light transmission through a window or sliding glass door while reducing ultraviolet radiation received inside the building from sunlight, thereby protecting object inside the building.

But yet still another object of this invention is to provide an improved storm shutter that is economical in manufacture and installation, while at the same time providing extremely sturdy protection against wind velocities exceeding 200 mph.

In accordance with these and other objects which will be apparent hereinafter, the instant invention will now become described with particular reference to the accompanying drawings.

DESCRIPTION OF THE PREFERRED EMBODIMENTS

Figure 1:
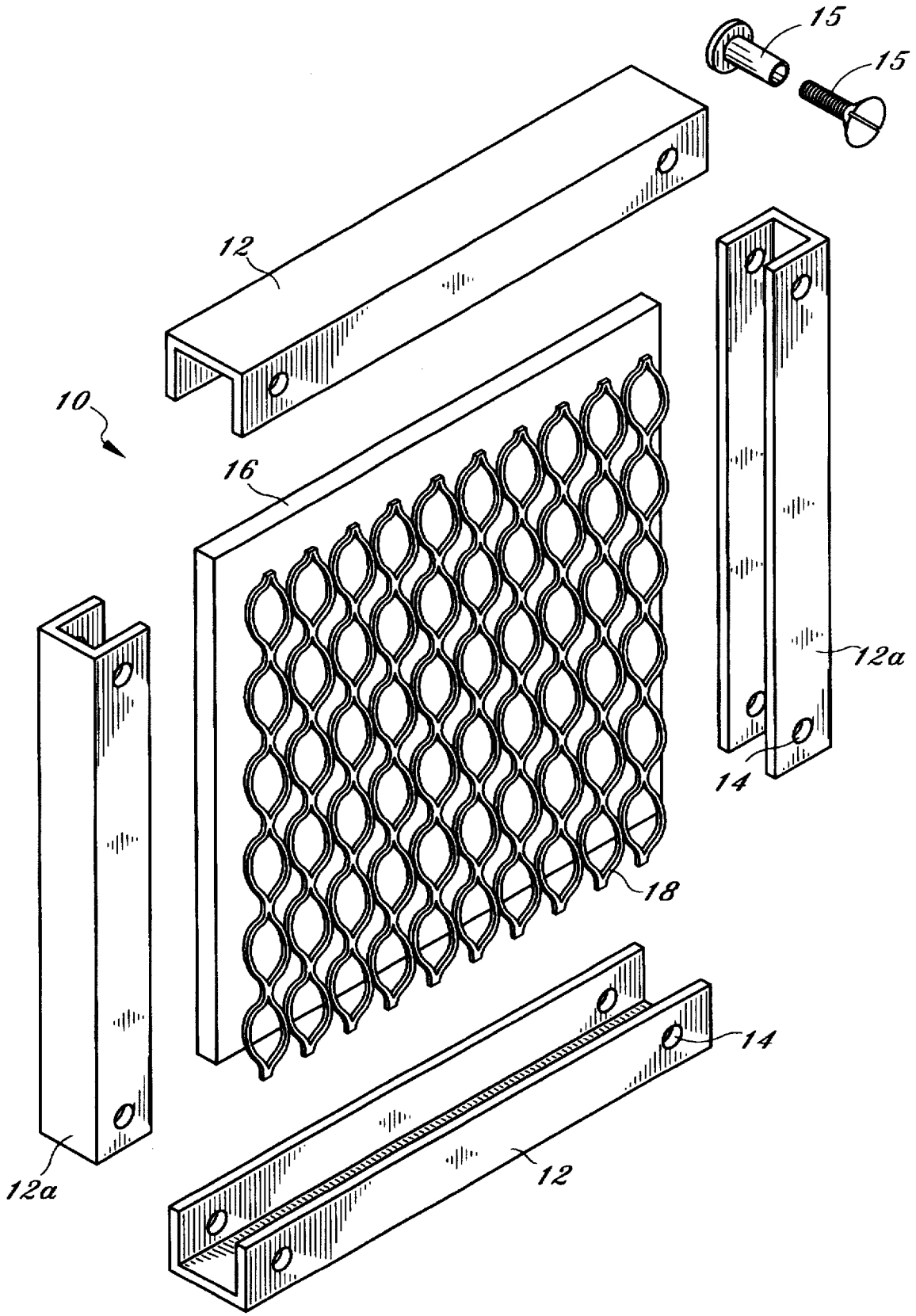
FIG. 1 shows a perspective exploded view of an improved storm shutter in accordance with the present invention.

Referring now to the drawings, and in particular, FIG. 1, the present invention is shown generally at 10, representing a single shutter that would cover a single window in accordance with the present invention. The shutter itself can be changed in dimensional sizes for larger windows, for covering a sliding glass door, or for covering doors. Typically, the improved shutter 10 is installed on the exterior wall surface of a building, such as a residential home or commercial building, over the window or door section. A typical installation can be done, wherein top and bottom U-shaped tracks are provided that are made of a rigid material, such as aluminum, that are permanently anchored above the top ledge and below the bottom ledge of the window opening on the exterior portion of the building. An improved shutter, as shown in FIG. 1, would then be positioned over the window by sliding from one direction or another horizontally along the tracks. Additional end fasteners would then be provided at each end to prevent lateral movement of the shutter while it is mounted on the tracks.

Looking at FIG. 1, the basic improved shutter 10 includes substantially a rectangular frame made up of four single frame elements 12 and **12*a* that are U-shaped, extruded aluminum for rigidity, having parallel members 12 and 12*a* on opposite sides that can overlap and be joined together by fasteners 15 that are disposed through a plurality of apertures 14 in each corner area. The particular length of the frame members 12 and 12*a*** can be varied, and in fact, a double-type storm shutter can be produced with a center H-shaped frame member to form two separate, independent sections in one large frame housing for larger applications.

The shutter 10 includes a single rectangular one-quarter inch thick polycarbonate sheet 16 that is transparent to allow light therethrough that may be typically sized one-quarter inch in thickness and be rectangularly shaped to fit snugly within the plurality of frame members 12 and **12*a* on each edge. The polycarbonate sheet composition is basically a linear polymer of carbonic acid, which is a thermoplastic, synthetic resin made from bisphenol and phosgene, typically is used. In one example, the polycarbonate can be a group of polyesters formed from carbonic acid, generally called polycarbonate and currently sold under various trade names, including the trademark Lexan, which is owned by the General Electric Company. In addition to the polycarbonate, transparent sheet 16 shown in FIG. 1, the shutter 10 includes a rigid, expanded metal (preferably aluminum) element 18, which has a pattern of openings or spaces integrally formed by rigid expanded aluminum one-quarter inch thick strips that are formed in a sheet that have at least 50% open space or more between the strips to insure adequate light transmission. The expanded aluminum can be done in distinctive spatial patterns, i.e. diamond-shaped, elliptical-shaped, or other desired patterns for aesthetic purposes. One expanded aluminum element 18 is sized around its perimeter and thickness to correspond to the perimeter of the polycarbonate sheet and to fit snugly within the frame members 12 and 12*a* as shown in FIG. 1 along all sides. The thickness of the expanded aluminum element is approximately one-quarter inch in the preferred embodiment, such that when placed against one side of the one-quarter inch polycarbonate sheet, and encompassed by the U-shaped aluminum frame members, which are one-half inch across each U-shaped inside channel of each frame member 12 and 12***a*, both the polycarbonate sheet and the expanded aluminum are snugly fit tight into the frame members 12 and 12*a* to eliminate any type of vibration and to form a completely rigid, independent storm shutter. Once the frame members and the polycarbonate sheet 16 and the expanded aluminum element 18 are firmly housed within the frame, and the frame member is secured by fasteners or rivets, the shutter 10 is ready for a plurality of different types of mountings on the exterior surface, covering the window, glass sliding doors or regular door. Such a mounting could be in sliding tracks, side-to-side, with a top and bottom U-shaped track permanently affixed to the building above and below the window opening. Each improved shutter could also be hinged on either side of a window or door and swing away. The shutter 10 could also be permanently or semi-permanently mounted in place by bolts at each corner in frames to hold the device firmly in place. Finally, each improved shutter could be hinged at the top for mobility away from the building at the bottom and held in place by support arms at the bottom that are adjustable in length.

The polycarbonate sheet utilized in the present invention as shown in FIG. 1 can be clear or can be tinted, depending on the manufacturer. It is very desirable that the polycarbonate sheet 16 filters out undesirable ultraviolet rays that may come through from the sun to protect objects inside the building from damage from ultraviolet rays. This is typically provided in polycarbonate sheets, such as are made under the Lexan trademark.

Figure 2:
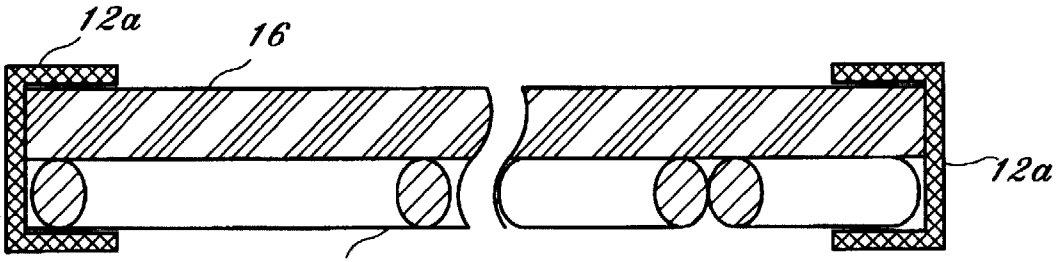
FIG. 2 shows a top plan view in cross section through a mid-portion of a storm shutter made in accordance with the present invention.

FIG. 2 shows a top plan view of the shutter including the frame members 12*a* and the snug fit of the polycarbonate sheet 16 at each end and against the inside channel of the frame members 12*a*, in conjunction with the snug fit of the expanded aluminum element 18 at each end and against the inside channel of frame members 12*a* so that there is no room for vibration between either the polycarbonate sheet 16 or the expanded aluminum element 18 and the frame members 12 and 12*a* themselves.

Figure 3:
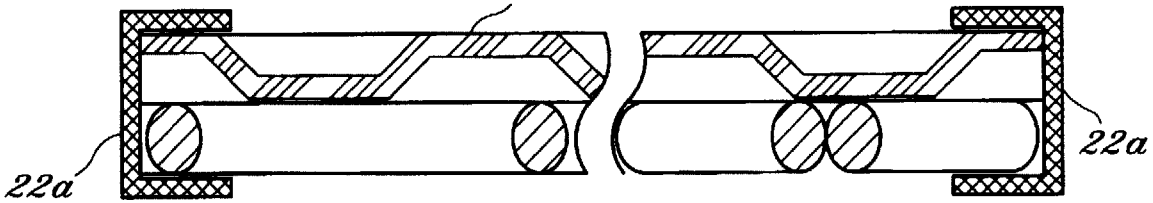
FIG. 3 shows a top plan view in cross section of an alternate embodiment of the present invention, employing a polycarbonate, transparent sheet of a different cross sectional profile that is corrugated.

FIG. 3 shows an alternate embodiment of the invention, wherein the polycarbonate sheet 20 may be corrugated while still retaining its strength and snug fit so that the corrugated surface still has a tightness that is provided between the ends of the frame members 12*a* and between the expanded aluminum element 18 for a tight fit in the frame. The corrugated polycarbonate sheet 20 is a variation of the flat polycarbonate sheet for aesthetic or sizing considerations.

Figure 4:
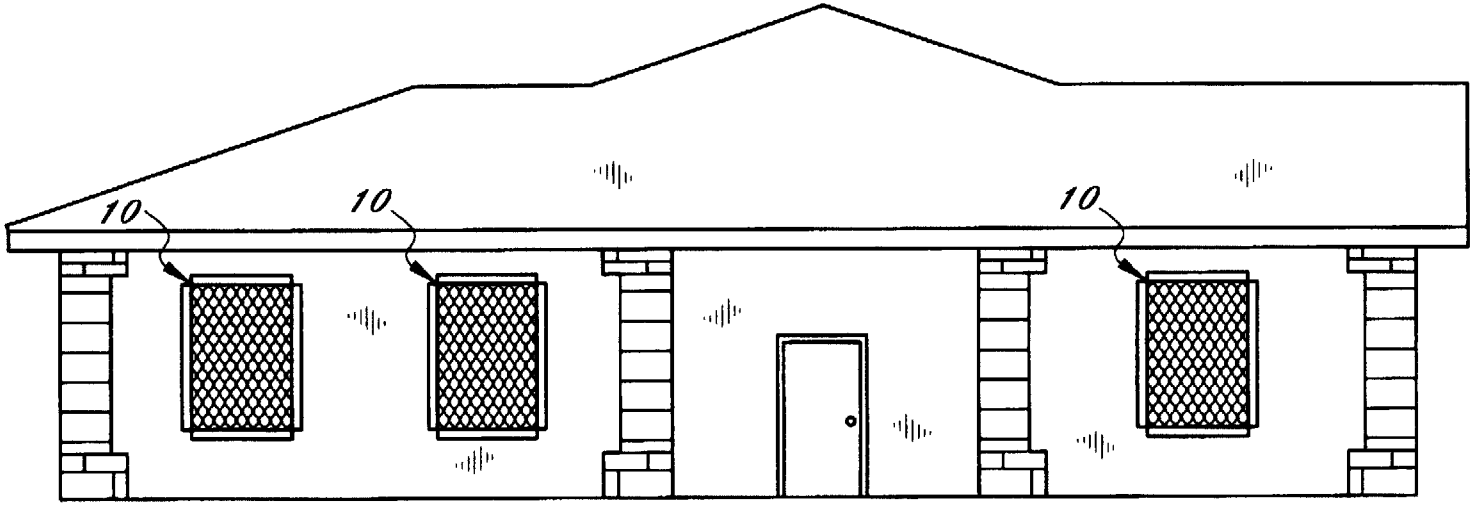
FIG. 4 shows a front elevational view of a house with storm shutters as would be typically installed on the exterior wall of a building.

FIG. 4 shows the improved shutters 10 as they would be installed on a typical dwelling, covering windows. Each shutter 10, as shown in FIG. 1, constitutes an independent shutter that will cover a particular window. The size of each shutter can be varied to fit the need of the particular window. In the preferred embodiment, the polycarbonate sheet is one-quarter inch in thickness and the expanded aluminum is one-quarter inch in thickness, which has been found to withstand winds in excess of 200 mph. In order to cover a large area with sufficient strength, a center bar that is H-shaped in cross section could be employed within a rectangular aluminum frame as a center member, dividing an improved shutter into two separate sections, each containing its own polycarbonate sheet, and each containing its own expanded aluminum, with sufficient spacing in it to provide translucent light.

With the use of the present invention, the storm shutter can provide protection for winds above 200 mph for windows and doors. It also protects from pounding rains and flying projectiles. The device can be installed as a security device and does not have to be removed when there are occupants in the house because of the ability to allow light to pass through the shutter without sacrificing security. The device can be made cost-effective and competitive with other types of shutters by virtue of the small quantity of polycarbonate sheet required, which still has strength when used in conjunction with the expanded aluminum, which provides strength and also openness. Another important aspect is that overall, each improved shutter can be lightweight, can be easy to install, and does not require electrical devices for raising or lowering. Finally, the shutters will protect the objects inside the building from ultraviolet rays.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An improved storm shutter for mounting on the exterior of a building, both permanently and removably, for protecting one of windows, doors, and sliding glass doors, said improved storm shutter comprising:

a corrugated polycarbonate, shatter-proof transparent sheet, said polycarbonate sheet having properties such that ultraviolet radiation is filtered from sunlight passing therethrough;

an expanded aluminum element having a plurality of openings therethrough for allowing transmission of light through the storm shutter; and a rigid frame, said polycarbonate sheet being placed adjacent said expanded aluminum element and in contact therewith, said polycarbonate, transparent sheet and said expanded aluminum element being secured about a peripheral edge by said frame, said polycarbonate, transparent sheet and said expanded aluminum element fitting tightly into said frame to eliminate vibration and to form a completely rigid, independent storm shutter;

said storm shutter providing protection from winds traveling in excess of 200 mph, said storm shutter having an exterior facing side and an interior facing side, said expanded aluminum element being disposed on the exterior facing side of said shutter.

2. An improved storm shutter for protecting windows, doors, and sliding glass doors as in claim 1, wherein said rigid frame means includes first, second, third, and fourth U-shaped metal bars, said polycarbonate, transparent sheet having a predetermined thickness and said expanded aluminum element having a predetermined thickness, such that the peripheral edges of said polycarbonate, transparent sheet and said expanded aluminum element fit snugly inside said frame U-shaped channel members thereby preventing said polycarbonate sheet and said expanded aluminum from causing noise resulting from wind generated vibration.

3. An improved storm shutter for protecting windows, doors, and sliding glass doors as in claim 2, wherein said expanded aluminum element includes a plurality of openings that form a distinct, decorative pattern and have at least 50% open spacing for the transmission of light through said shutter.

4. An improved storm shutter for protecting windows, doors, and sliding glass doors as in claim 1, wherein said rigid frame means includes first, second, third, and fourth U-shaped metal bars, said polycarbonate, transparent sheet having a thickness and said expanded aluminum element having a thickness, such that the peripheral edges of said polycarbonate, transparent sheet and said expanded aluminum element fit snugly inside said frame U-shaped channel members thereby preventing said polycarbonate sheet and said expanded aluminum from causing noise resulting from wind generated vibration.

* * * * *